United States Patent [19]

Roller

[11] Patent Number: 4,768,769

[45] Date of Patent: Sep. 6, 1988

[54] LOW COST REAR AIR KNIFE TOP VACUUM CORRUGATION FEEDER

[75] Inventor: George J. Roller, Penfield, N.Y.

[73] Assignee: Xerox Corporation, Stamford, Conn.

[21] Appl. No.: 943,451

[22] Filed: Dec. 19, 1986

[51] Int. Cl.[4] ..... B65H 3/12

[52] U.S. Cl. ..... 271/11; 271/93; 271/98; 271/171

[58] Field of Search ..... 271/93, 98, 90, 11-13, 271/171

[56] References Cited

U.S. PATENT DOCUMENTS

| | | | |
|---|---|---|---|
| 2,895,552 | 7/1959 | Pamper et al. | 164/68 |
| 2,979,329 | 4/1961 | Cunningham . | |
| 3,424,453 | 1/1969 | Halbert | 271/35 |
| 3,931,964 | 1/1976 | Schwebel | 271/93 |
| 4,157,177 | 6/1979 | Strecker | 271/197 |
| 4,184,672 | 1/1980 | Watkins et al. | 271/105 |
| 4,268,025 | 5/1981 | Murayoshi | 271/112 |
| 4,451,028 | 5/1984 | Holmes et al. | 271/11 |
| 4,470,589 | 9/1984 | Singer | 271/11 |
| 4,627,605 | 12/1986 | Roller | 271/98 X |
| 4,627,606 | 12/1986 | Moore | 271/106 X |

FOREIGN PATENT DOCUMENTS

| | | |
|---|---|---|
| 2461668 | 2/1984 | France . |
| DL138184 | 10/1979 | U.S.S.R. . |

*Primary Examiner*—Richard A. Schacher

*Attorney, Agent, or Firm*—William A. Henry, II

[57] ABSTRACT

A sheet feeding apparatus with a sheet support tray, a rear vacuum plenum chamber adapted to acquire the rear portion of a sheet, a front vacuum plenum chamber positioned over the front of the sheet and adapted to acquire the front portion of a sheet, a sheet transport associated with the front vacuum plenum to transport a sheet acquired in a forward direction and an air knife positioned at the rear of the stack of sheets to inject air between the trailing edge of the top sheet in a stack and the remainder of the stack. The trail edge of a sheet in a stack is separated by the air knife, acquired by the rear vacuum plenum then acquired by the front vacuum plenum and transported in a forward direction. As the trailing edge clears the rear vacuum, the rear vacuum, which together with the air knife is continuously actuated, acquires the next sheet in the stack. In this way, the speed of the sheet feeder can be very high since sheets are separated and acquired by the feeder simultaneously with transporting them off the stack. Preferably, the air knife includes preacquisition fluffer jets to initially loosen the top few sheets in the stack and lateral converging air streams to facilitate separation of the topmost sheet in the stack. The front vacuum plenum includes sheet acquisition tunnels over virtually its entire sheet contact surface in order to accommodate a wide variety of sheet sizes.

10 Claims, 3 Drawing Sheets

LOW COST REAR AIR KNIFE TOP VACUUM CORRUGATION FEEDER

The present invention relates to sheet feeding apparatus and in particular to high speed sheet separating and feed apparatus. A specific embodiment is directed to a top vacuum corrugating feeding apparatus with two vacuum plenums, one for top sheet acquisition and the other for top sheet transport.

With the current high speed xerographic copy reproduction machines wherein copies can be produced at a rate in excess of several thousand copier per hour, the need for a sheet feeder to feed cut copy sheets to the machine in a rapid, dependent manner was recognized to enable full utilization of the reproduction machine's potential copy output. In particular for many purely duplicating operations, it is desired to feed cut copy sheets at very high speeds where multiple copies are made of an original placed on the copying platen. In addition, for many high speed copying operations, a document handler to feed documents from a stack to a copy platen of the machine in a rapid dependable manner has also been reorganized to enable full utilization of the machine's potential copy output. These sheet feeders must operate flawlessly to virtually eliminate the risk of damaging the sheets and generate minimum machine shutdowns due to uncorrectable misfeeds or sheet multifeeds. It is in the initial separation of the individual sheets from the sheet stack where the greatest number of problems occur.

Since the sheets must be handled gently but positively to assure separation without damage through a number of cycles, a number of separators have been suggested such as friction rolls or belts used for fairly positive document feeding in conjunction with a retard belt, pad, or roll to prevent multifeeds. Vacuum separators such as sniffer tubes, rocker type vacuum rolls, or vacuum feed belts have also been utilized.

While the friction roll-retard systems are very positive, the action of the retard member, if it acts upon the printed face can cause smearing or partial erasure of the printed material on the document. With single sided documents if the image is against the retard mechanism, it can be smeared or erased. On the other hand, if the image is against the feed belt it smears through ink transfer and offset back to the paper. However, with documents printed on both sides the problem is compounded. Additionally, the reliable operation of friction retard feeders is highly dependent on the relative frictional properties of the paper being handled. This cannot be controlled in a document feeder.

One of the sheet feeders best known for high speed operation is the top vacuum corrugation feeder with front air knife. In this system, a vacuum plenum with a plurality of friction belts arranged to run over the vacuum plenum is placed at the top of a stack of sheets in a supply tray. At the front of the stack, an air knife is used to inject air into the stack to separate the top sheet from the remainder of the stack. In operation air is injected by the air knife toward the stack to separate the top sheet, the vacuum pulls the separated sheet up and acquires it. Following acquisition, the belt transport drives the sheet forward off the stack of sheets. In this configuration, separation of the next sheet cannot take place until the top sheet has cleared the stack. In addition, acquisition of the next sheet in the stack cannot occur until the top sheet has cleared the vacuum plenum. In this type of feeding system every operation takes place in succession or serially and therefore the feeding of subsequent sheets cannot be started until the feeding of the previous sheet has been completed. This procedure takes time and therefore limits the potential operational speed of the sheet feeder. In such a system in order to try to increase the throughput speed, it has been proposed to activate the vacuum and the transport belts continuously. This frequently results in a difficulty in acquiring the top sheet in a stack since it must be acquired by a vacuum over which friction belts are moving. In addition, the second sheet can be prematurely acquired as the trail edge partially clears the vacuum plenum. An overlay multifeed may occur that must be separated with another device. Thus the inherent structure in such a system limits its potential operational speed. In addition, in this type of system the air knife may cause the second sheet to vibrate independent of the rest of the stack in a manner referred to as "flutter". When the second sheet is in this situation, if it touches the top sheet, it may tend to creep forward slightly with the top sheet. The air knife then may drive the second sheet against the first sheet causing a shingle or double feeding of sheets.

A sheet feeder in answer to the above-mentioned problem is U.S. Pat. No. 4,451,028 in which a rear air knife vacuum corrugation feeder is disclosed that uses a moving carriage to position an air knife assembly as well as a rear vacuum assembly with respect to the trail edge of a copy sheet stack, but the moving carriage applies a cost burden to the apparatus. This patent is incorporated herein by reference to the extent necessary to practice the present invention.

Relevant prior art can be summarized as follows:

U.S. Pat. No. 2,979,329 (Cunningham) describes a sheet feeding mechanism useful for both top and bottom feeding of sheets wherein an oscillating vacuum chamber is used to acquire and transport a sheet to be fed. In addition, an air blast is directed to the leading edge of a stack of sheets from which the sheet is to be separated and fed to assist in separating the sheets from the stack.

U.S. Pat. No. 3,424,453 (Halbert) illustrates a vacuum sheet separator feeder with an air knife wherein a plurality of feed belts with holes are transported about a vacuum plenum and pressurized air is delivered to the leading edge of the stack of sheets. This is a bottom sheet feeder.

U.S. Pat. No. 2,895,552 (Pomper et al.) illustrates a vacuum belt transport and stacking device wherein sheets which have been cut from a web are transported from the sheet supply to a sheet stacking tray. Flexible belts perforated at intervals are used to pick up the leading edge of a sheet and release the sheet over a pile for stacking.

U.S. Pat. No. 4,157,177 (Strecker) illustrates another sheet stacker wherein a first belt conveyor delivers sheets in a shingled fashion and the lower reach of a second perforated belt conveyor which is above the top of the stacking magazine attracts the leading edge of the sheets. The device has a slide which limits the effect of perforations depending on the size of the shingled sheet.

U.S. Pat. No. 4,268,025 (Murayoshi) describes a top sheet feeding apparatus wherein a sheet tray has a vacuum plate above the tray which has a suction hole in its bottom portion. A feed roll in the suction hole transports a sheet to a separating roll and a frictional member in contact with the separating roll.

French Reference No. 2,461,668 discloses a sheet unstacking and dispensing machine having a rear air nozzle and an overhead vacuum plate. The rear air nozzle forces the top sheet of a stack into contact with the overhead vacuum plate. A roller located at the front of the vacuum plate then dispenses the top sheet from the vacuum plate.

U.S. Pat. No. 4,184,672 (Watkins et al.) shows a sheet feeding apparatus that includes a rear air blast nozzle and a rear suction cup mechanism. Means for controlling the supply of vacuum and compressed air to the sheet feeding apparatus is also included. A sheet is separated from the top of a stack by the rear air blast nozzle. The rear suction cup grips the trail edge of the sheet and forces the sheet forward into contact with a transport mechanism.

U.S. Pat. No. 4,470,589 (Singer) is directed to a sheet feeding apparatus that includes a primary rear air nozzle, a secondary rear air nozzle and a rear air suction cup mechanism. The primary rear air nozzle separates the trail edge of the top sheet from a stack. There rear suction cup mechanism grips and lifts the trail edge of the sheet. The secondary rear air nozzle injects pressurized air between the sheet and the stack, thereby forcing the sheet into contact with a transport path.

Russian Reference No. 138,184 discloses a sheet feeding mechanism having a rear air jet and overhead suction members. The rear air jet forces the top sheet of a stack into contact with overhead suction members. The front suction member then dispenses the top sheet from the stack.

The above-mentioned references are incorporated herein by reference.

Accordingly, a low cost rear air knife vacuum corrugation feeder in an aspect of the present invention includes a sheet feeding apparatus comprising a sheet stack support tray, a rear vacuum plenum chamber positioned over the rear portion of said sheet stack support tray and adapted to acquire the rear portion of a sheet when sheets are in said tray, a front vacuum plenum chamber positioned over the front of said sheet stack support tray and adapted to acquire the front portion of a sheet when sheets are in said tray, said rear and front vacuum plenum chambers each having a portion positioned in its bottom center to provide a center corrugation member parallel to the sheet feeding direction, sheet transport means associated with said front vacuum plenum to transport the sheet acquired by said front vacuum plenum in a forward direction out of said sheet stack support tray, and air knife means positioned at the rear of said sheet stack support tray and adapted to inject air between the trailing edge of the top sheet in a stack of sheets and the remainder of the stack when a stack of sheets is in said tray, the improvement characterized by said front vacuum plenum chamber being provided with openings that lie just inside the lead edge of the smallest sheet to be fed, said openings being adapted to induce a negative pressure gradient above the sheet stack and thereby causing a sheet to adhere to said front vacuum plenum chamber, and acquisition tunnels connected to said openings to allow flow to reach all areas of the sheet.

For a better understanding of the invention as well as other features thereof, reference is made to the following drawings and descriptions.

The invention will now be described with reference to a preferred embodiment of the high speed sheet feeding apparatus. As used herein the term "high speed sheet feeding" is intended to mean the feeding of sheets at a speed greater than one per second. Typically, apparatus according to the present invention is capable of feeding sheets in excess of four sheets per second and has achieved sheet feeding rates as high as seven to ten sheets (8½"×11", long edge feed) per second.

Figure 1:
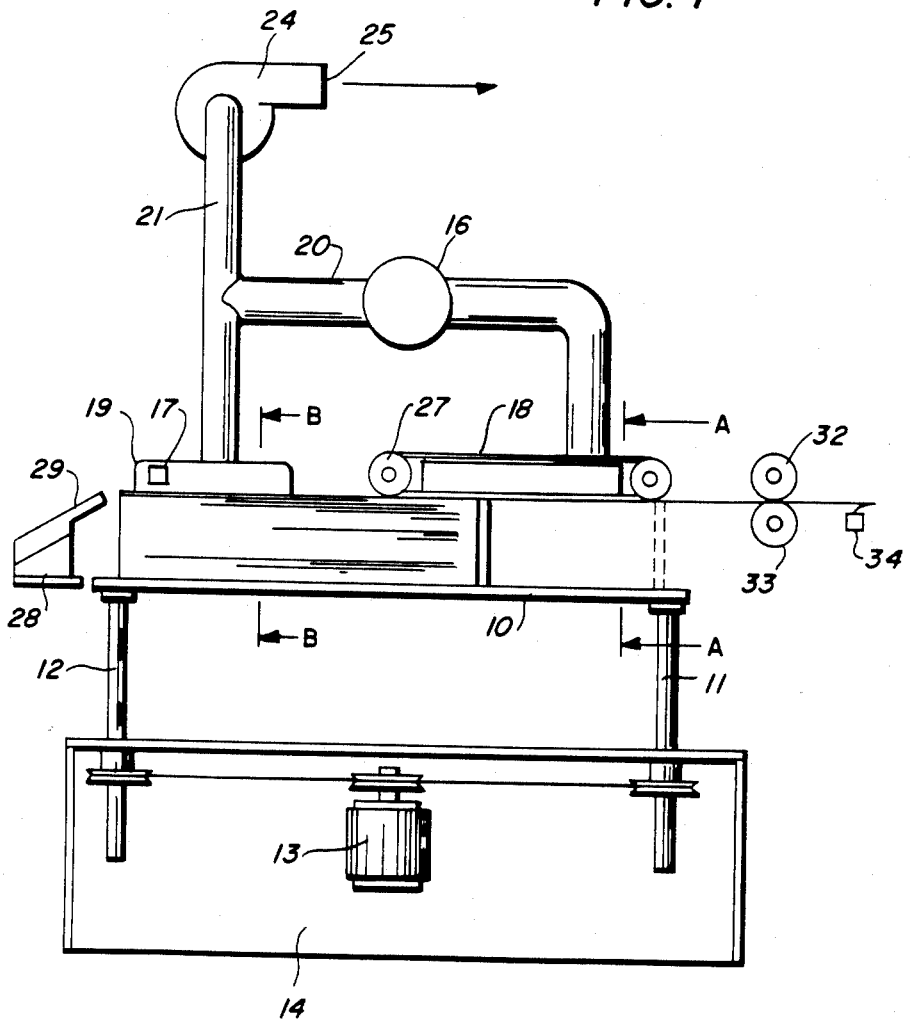
FIG. 1 is a cross-sectional side view of an exemplary sheet feeder employing the present invention.

Referring more particularly to FIG. 1, there is illustrated an exemplary sheet separator feeder for installation adjacent to the exposure plates of a conventional xerographic reproduction machine for feeding of documents to the platen for copying. Alternatively or in addition, the sheet feeder may be mounted at the beginning of the paper path for the feeding of cut sheets of paper. In either situations, the feeder illustrated is merely one example of a sheet separation feeder which may be used according to the present invention. The sheet feeder is provided with a sheet stack supporting tray 10 which may be raised and lowered through electric power screws 11,12 by means of motor 13 from the base support platform 14. The drive motor is actuated to move the sheet stack support tray vertically upward by stack height sensor 17 when the level of sheets relative to the sensor falls below a first predetermined level. The drive motor is deactuated by the stack height sensor 17 when the level of the sheets relative to the sensor is above a predetermined level. The stack height sensor is located at the rear and at a side of the stack of paper to sense height level. In this way the level of the top sheet in the stack of sheets may be maintained within relatively narrow limits to assure proper sheet separation, acquisition and feeding. The illustrated device provides both a front and a rear vacuum plenum arrangement to perform separate functions in the steps of sheet acquisition and transport. The front vacuum plenum 18 and the rear vacuum plenum 19 are supplied with low air pressure source through conduits 20, 21 by means of vacuum pump 24. When the pump 24 is activated, air is pulled from both the front and rear vacuum plenums through the pump to exhaust 25. A valve 16 is placed in the air conduit 20 supplying the front vacuum plenum. The front vacuum plenum also has associated with it a belt transport assembly for transporting the top sheet in the stack from the stack.

At the rear of the stack of sheets is an air injection means or air knife 28 having at least one nozzle 29 directed to the rear of trailing edge of the top sheet in a stack of sheets to be fed. The air knife serves to direct a continuous blast of air at the trailing edge of a sheet to separate the top sheet from the remainder of the stack by inserting a volume of air therebetween. In this embodiment, the air knife performs two functions, preacquisition separation of sheets, and if necessary, a post acquisition separation of the top sheet from the remainder of the stack.

In operation, the sheet stack support tray 10 is elevated by power screws, 11, 12 and advances the topmost sheet to the sheet feeding level. The vacuum pump 24 is actuated and continuously exhausts air from lines 21 and 20, it being noted that line 20 is periodically closed by valve 16. In addition, the air knife is continuously actuated to inject air between the top sheet and the remainder of the stack and serves to separate the top sheet from the remainder of the stack. Once separated, the trailing portion of the top sheet is readily acquired by the rear vacuum plenum 10. With the value 16 open, the front of the topmost sheet is acquired by the front plenum 18 as the air knife 28 continues to direct air into the space formed between the top sheet and the remainder of the stack, and forces a separation of the top sheet from the remainder of the stack. The belt transport assembly is actuated and the top sheet which has been acquired by both vacuum plenums, is driven forward from the stack. The sheet is fed forward since the driving force on the sheet from the belt transport and front plenum assembly is greater than the drag force exerted on the sheet by the rear plenum. For both plenum chambers the force exerted F is controlled by the pressure applied, times the area of the sheet exposed to the vacuum, times the coefficient of friction. Since the pressure applied may be the same in both plenum chambers, it does not have to be the controlling factor. The area of exposure and the coefficient of friction, with reference to the rear plenum, are relatively low and hence the drag force is also relatively low. In contrast, the belt assembly associated with the front plenum provides a relatively large area of contact with the top sheet and has a surface with a relatively high coefficient of friction. Thus, the frictional driving force exerted on the sheet by the front vacuum and by the belt transport assembly is greater than the drag force exerted on the sheet by the rear vacuum plenum.

Typically in operation, the air knife 28 and the rear vacuum plenum 19 are constantly actuated while the front vacuum plenum 18 and belt transport 27 are pulsed for each sheet that is fed to insure an intercopy gap between the sheets being fed and to avoid the possibility of sheets shingling out with the top sheet and giving rise to shingle sheet feeding or multisheet feeding. Generally, the belt transport and the front vacuum plenum are pulsed simultaneously to start and stop the vacuum and the belt drive. Alternatively, the belt transport assembly may be continuously driven while the front vacuum plenum is pulsed on and off for each sheet feed. This is a possible alternative because if the vacuum in the front plenum is turned off the transport belt may continue to advance the top sheet since its leading edge may have already been captured by the output feed rolls 32, 33 which will deliver the top sheet from the tray. Output feed rolls continuously drive separated sheets onto the next operating station in the process. At the nip of the output feed roll pair is a sensor 34 for sensing the lead edge of the sheet. This sensor, by its location, automatically determines that a sheet has been separated and fed and is under a different drive system. Accordingly, the front vacuum plenum and the belt transport may be deactuated.

Figure 2:
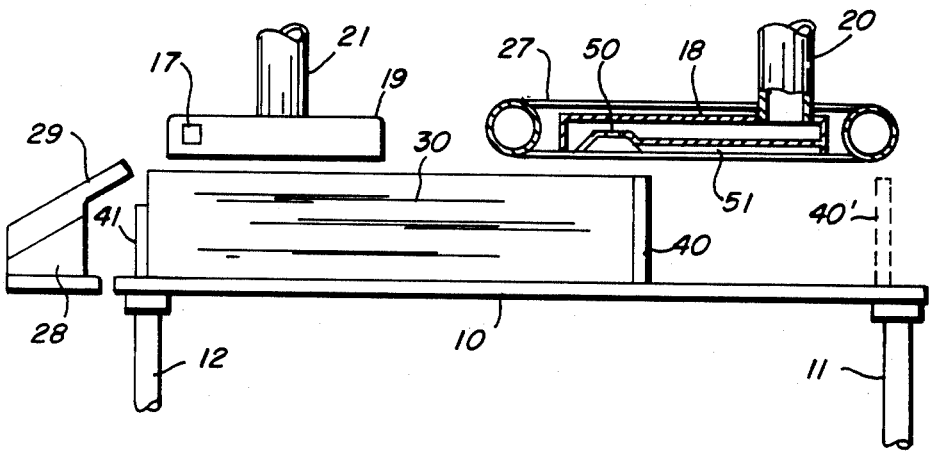
FIG. 2 is an enlarged partial cross-sectional side view of the sheet feeder of FIG. 1 showing an acquisition tunnel in a front vacuum plenum.
Figure 3:
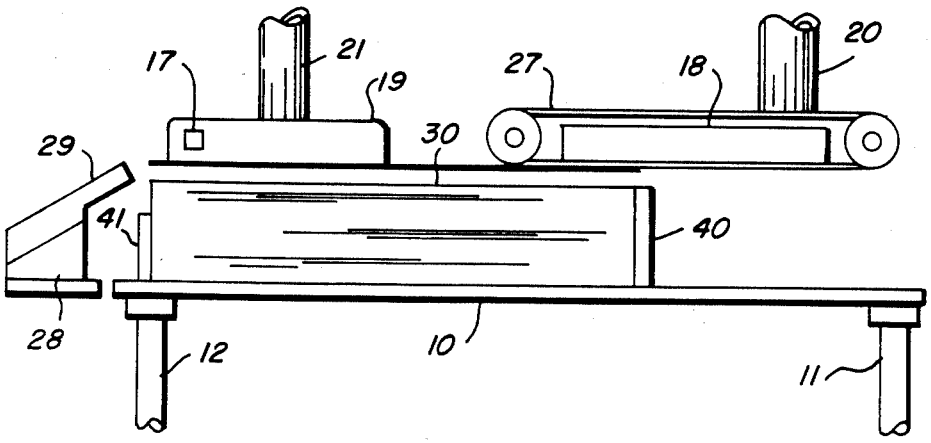
FIG. 3 is an enlarged partial cross-sectional side view of the sheet feeder of FIG. 2 after a B5 size sheet has been acquired.
Figure 4:
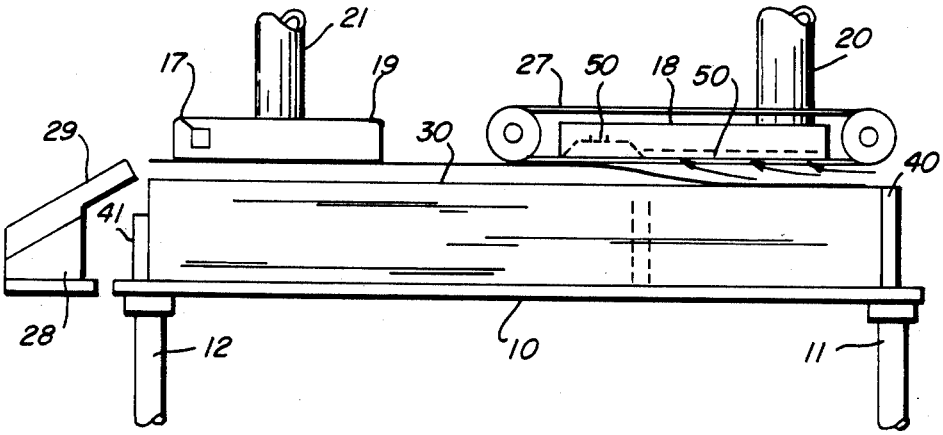
FIG. 4 is an enlarged partial cross-sectional side view of the sheet feeder of FIG. 1 in position to feed A3 size sheets.
Figure 4A:
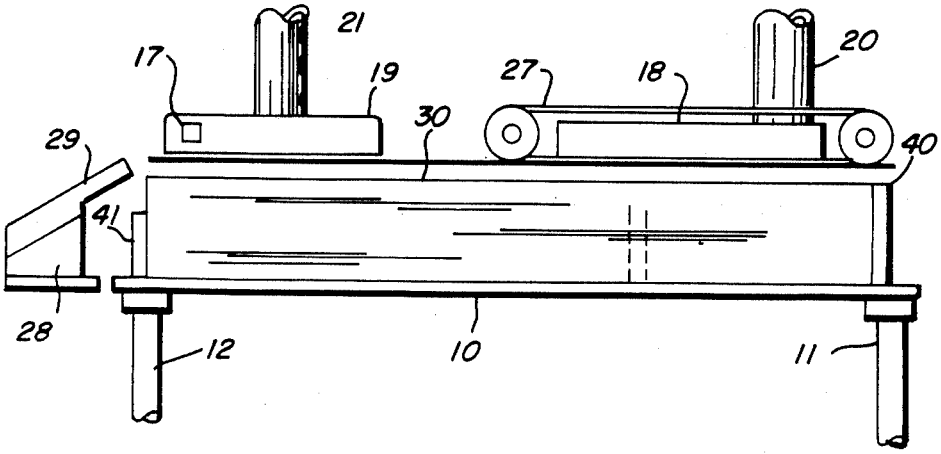
FIG. 4A is an enlarged partial cross sectional side view of the sheet feeder of FIG. 4 showing an A3 sheet having been acquired by front and rear vacuum plenums.

Reference to FIGS. 2–4A will schematically illustrate how the sheet feeder of the present invention is an improvement over the sheet feeder in U.S. Pat. No. 4,451,028. In FIG. 2, the front vacuum feedhead assembly includes a vacuum plenum 18, vacuum ports 50 and one of a plurality of acquisition tunnels or channels 51 that allow the feedhead assembly to acquire and feed A4 ($8\frac{1}{2}'' \times 11''$) and A3 ($11'' \times 14''$) sheets with equal ease and with fewer mechanical parts than the U.S. Pat. No. 4,451,028 feeder. Sheets are acquired and separated at the stack trail edge precisely as is done with the U.S. Pat. No. 4,451,028 feeder, however, the air knife assembly and the rear vacuum plenum in the U.S. Pat. No. 4,451,028 have to be positioned at the trail edge of a sheet stack for various sheet sizes. To eliminate the cost associates with moving both the air knife assembly and rear vacuum plenum and in accordance with the present invention air knife 28 and rear vacuum plenum 14 are stationary and sheets 30 are rear edge registered against tray end stop 41. Openings in front vacuum plenum 18 lie just inside the lead edge of B5 sheets. These openings permit vacuum flow which induces a negative pressure gradient above the stack, causing a sheet to tack to the feedhead assembly and belt transport 27 as shown in FIG. 3. For larger sheets (A3), stack front edge guide 40 is moved from the solid line position in FIG. 1 to the solid line position in FIG. 4 and as shown in FIG. 4A, a sheet is first acquired at the vacuum port opening 50. However, the presence of continuous acquisition tunnels 51 allows vacuum flow to be continually drawn over the stack as indicated by the arrows in FIG. 4, thereby enhancing the front vacuum plenum in acquiring the whole sheet as in FIG. 4A. Due to acquisition tunnels 51, B5 size sheets are continually held and driven by transport belt 27 until each reaches a set of take-away rolls 32, 33.

The rear air knife vacuum corrugation feeder of the present invention provides a very high speed reliable sheet feeder at a more reduced cost than heretofore contemplated. The feeder employs a stationary rear air knife and rear vacuum plenum in conjunction with a sheet stack tray having a rear edge registration member. A front vacuum plenum has sheet acquisition tunnels therein in order to increase the size of sheets that can be accommodated by the apparatus without movement of the air knife or front and rear plenums. The continuous acquisition tunnels are positioned over the entire feedhead assembly which assures acquisition of a whole sheet area.

It will be appreciated that the described device may be modified ad varied by the skilled artisan upon a reading of the present disclosure. For example, while the present invention has been described with reference to a stationary feedhead and a elevating sheet stacking tray, a stationary tray and moving feedhead could be employed. This modification together with other modifications as may readily occur to the artisan are intended to be within the scope of the present invention.

What is claimed is:

1. In a sheet feeding apparatus that feeds sheets from the top of a stack, comprising a sheet stack support tray, a rear vacuum plenum chamber positioned over the rear portion of said sheet stack support tray and adapted to acquire the rear portion of a sheet when sheets are in said tray, a front vacuum plenum chamber positioned over the front of said sheet stack support tray and adapted to acquire the front portion of a sheet when sheets are in said tray, said rear and front vacuum plenum chambers each having a portion positioned in its bottom center to provide a center corrugation member parallel to the sheet feeding direction, sheet transport means associated with said front vacuum plenum to transport the sheet acquired by said front vacuum plenum in a forward direction out of said sheet stack support tray, and knife means positioned at the rear of said sheet stack support tray and adapted to inject air between the trailing edge of the top sheet in a stack of sheets and the remainder of the stack when a stack of sheets is in said tray, the improvement that enables the feeding of multiple sizes of sheets is characterized by said sheet stack support tray including an adjustable front edge guide adapted for movement to a first position in order to accommodate the feeding of small size sheets and to a second extended position in order to feed large size sheets and wherein said front vacuum plenum chamber is provided with openings that are positioned with respect to said first position of said adjustable front edge guide to lie closely spaced from said adjustable front edge guide and just inside the lead edge of the smallest sheet to be fed, said openings being adapted to induce a negative pressure gradient above the sheet stack and thereby causing a sheet to adhere to said front vacuum plenum chamber, and acquisition tunnels connected to said openings to allow negative pressure flow to reach all areas of the sheet.

2. The sheet feeding apparatus of claim 1, wherein said rear vacuum plenum chamber and said air knife means are stationary.

3. The sheet feeding apparatus of claim 2, wherein said sheet stack is rear edge registered.

4. A sheet feed apparatus, comprising:

a support tray for supporting a stack of sheets for feeding therefrom, said support tray including a rear edge registration means for registering the stack of sheets thereagainst and an adjustable front edge guide adapted for movement to a first position in order to accommodate the feeding of small size sheets and to a second extended position in order to feed large size sheets;

a rear air knife positioned in relation to sheets in said tray to separate the top sheet in the stack from the remaining sheets in the stack;

rear vacuum plenum means adapted to acquire the edge of the sheet separated from the stack by said rear air knife; and front vacuum plenum means adapted to acquire the lead edge of the sheet separated from the stack by said rear air knife, and wherein said front vacuum plenum has openings that are positioned with respect to said first position of said adjustable front edge guide to lie closely spaced from said adjustable front edge guide and just inside the lead edge of the smallest sheet to be fed, said openings being adapted to induce a negative pressure gradient above the stack of sheets thereby causing a sheet to adhere to said front vacuum plenum, and acquisition tunnels connected to said openings to allow negative pressure flow to all areas of the sheet; and feed means for forwarding the sheet away from the stack of sheets for further processing.

5. The sheet feeding apparatus of claim 4, wherein said vacuum plenum includes means for corrugating sheets adhered thereto.

6. The sheet feeding apparatus of claim 4, wherein said rear air knife and said rear vacuum plenum are stationary.

7. The sheet feeding apparatus of claim 6, wherein said stack of sheets is rear edge registered.

8. The apparatus of claim 4, wherein each of said rear and front vacuum plenum means includes means for corrugating sheets adhered thereto.

9. In a sheet feeding apparatus, comprising a sheet stack support tray, said sheet stack support tray including an adjustable front edge guide adapted for movement to a first position in order to accommodate the feeding of small size sheets and to a second extended position in order to feed large size sheets, a rear vacuum plenum chamber positioned over the rear portion of said sheet stack support tray and adapted to acquire the rear portion of a sheet when sheets are in said tray, a front vacuum plenum chamber positioned over the front of said sheet stack support tray and adapted to acquire the front portion of a sheet when sheets are in said tray, said rear and front vacuum plenum chambers each having a portion positioned in its bottom to provide a corrugation member parallel to the sheet feeding direction, sheet transport means associated with said front vacuum plenum to transport the sheet acquired by said front vacuum plenum in a forward direction out of said sheet stack support tray, and air knife means positioned at the rear of said sheet stack support tray and adapted to inject air between the trailing edge of the top sheet in a stack of sheets and the remainder of the stack when a stack of sheets is in said tray, the improvement characterized by said front vacuum plenum chamber being provided with openings that are positioned with respect to said first position of said adjustable front edge guide to lie closely spaced from said adjustable front edge guide and just inside the lead edge of the smallest sheet to be fed, said openings being adapted to induce a negative pressure gradient above the sheet stackand thereby causing a sheet to adhere to said front vacuum plenum chamber, and acquisition tunnels connected to said openings to allow negative pressure flow to reach all areas of the sheet.

10. The sheet feeding apparatus of claim 9, wherein said acquisition tunnels comprise inverted U-shaped members.

* * * * *